US006045459A

United States Patent [19]

Sugimoto et al.

[11] Patent Number: 6,045,459

[45] Date of Patent: Apr. 4, 2000

[54] THREE-PIECE SOLID GOLF BALL

[75] Inventors: Kazushige Sugimoto; Keiji Moriyama, both of Shirakawa, Japan

[73] Assignee: Sumitomo Rubber Industries, Ltd., Hyogo-ken, Japan

[21] Appl. No.: 08/870,631

[22] Filed: Jun. 6, 1997

[30] Foreign Application Priority Data

Jun. 6, 1996 [JP] Japan ..... 8-144102

[51] Int. Cl.[7] ..... A63B 65/06; A63B 37/02; A63B 37/04

[52] U.S. Cl. ..... 473/373; 473/374; 473/354

[58] Field of Search ..... 473/373

[56] References Cited

U.S. PATENT DOCUMENTS 5,556,098 9/1996 Higuchi et al. ..... 473/373

FOREIGN PATENT DOCUMENTS

0637459A1 2/1995 European Pat. Off. .
2245580A 1/1992 United Kingdom .
2299518A 10/1996 United Kingdom .

*Primary Examiner*—Sebastiano Passaniti
*Assistant Examiner*—Mitra Aryanpour
*Attorney, Agent, or Firm*—Birch, Stewart, Kolasch & Birch, LLP

[57] ABSTRACT

The present invention provides a three-piece solid golf ball which is excellent in rebound performance, flight performance, durability and shot feel at the time of hitting. The present invention provides a three-piece solid golf ball which comprises a core (a) and a cover (3) formed on the core, the core having a two-layer structure of an inner layer core (1) and an outer layer core (2), wherein the inner layer core (1) has a diameter of 31 to 36 mm and a JIS-C hardness of 60 to 85 and the core (2) has a lower JIS-C hardness than the inner layer core by 5 to 25.

9 Claims, 1 Drawing Sheet

THREE-PIECE SOLID GOLF BALL

FIELD OF THE INVENTION

The present invention relates to a three-piece solid golf ball which is excellent in rebound performance, flight performance, durability and shot feel at the time of hitting.

BACKGROUND OF THE INVENTION

There are two sorts of golf balls. One is a solid golf ball such as two-piece solid golf ball, or a three-piece solid golf ball, etc. and is composed of a core made of a integrally molded rubber member and a thermoplastic resin cover made from ionomer resin which cover the core. The other is a thread wound golf ball and is produced by winding a thread rubber around a solid or liquid center and, followed by covering the center with a cover having a thickness of 1 to 2 mm of ionomer resin, balata, etc. Among the solid golf balls, the two-piece solid golf ball comprising a core and a cover are popular in the market because theses balls can be easily produced. The two-piece solid golf ball obtains long flight distance because of high ball velocity at the time of hitting, and is superior in durability and flight performance to the thread wound golf ball. Accordingly, the two-piece solid golf ball is used by many golfers, exclusively amateur golfers. On the contrary, the two-piece solid golf ball has poor shot feel and lacks controllability for approach shots because it produces a very small amount of spin amount. Therefore, the two-piece solid golf ball is not accepted by the professional golfers and high-level amateur golfers, who think that shot feel at the time of hitting and controllability are important.

For solving the defects of the two-piece solid golf ball, it is suggested to make the solid core in a two layer structure to form a three-piece solid golf ball. The solid core having the two-layer structure is described in Japanese Patent Kokai Nos. 241464/1985, 181069/1987 and 80377/1989, and the structural feature used in the Japanese Patents is that the hardness of the outer layer core is set to a value higher than that of the inner layer core. That is, the amount of deformation of the golf ball is increased by making the hardness of the outside of the core higher and gradually decreasing the hardness from the outside to the inside, thereby obtaining soft shot feel. In this structure, however, the durability of the golf ball is not satisfactory.

Japanese Patent Kokal No. 23069/1994 suggests a similar three-piece structure wherein the hardness of the outer layer core is set at a value lower than that of the inner layer core. In this structure, with respect to hardness distribution, the hardness of the outside is highest and the hardness decreases gradually from the outside to inside. Therefore, there remains a problem that the rebound performance of the inner layer core is poor and the flight distance is short.

OBJECTS OF THE INVENTION

The present inventors have intensively studied so as to accomplish the above object. As a result, it has been found that, in a golf ball comprising a core (a) and a cover (3) formed on the core, the core having a two-layer structure comprising an inner layer core (1) and an outer layer core (2), the flight performance and durability are improved without causing a deterioration in the shot feel and rebound performance, by setting the specific gravity of the core, and the diameter, a hardness and a hardness distribution of the inner layer core (1), the hardness of the outer layer core (2) and the hardness of the cover (3) within a specific range. Thus, the present invention has been accomplished.

The main object of the present invention is to solve the above problems of a conventional solid golf ball, thereby providing a three-piece solid golf ball which is superior in rebound performance, flight performance, durability and feeling at the time of hitting.

This object as well as other objects and advantages of the present invention will become apparent to those skilled in the art from the following description with reference to the accompanying drawings.

SUMMARY OF THE INVENTION

Figure 1:
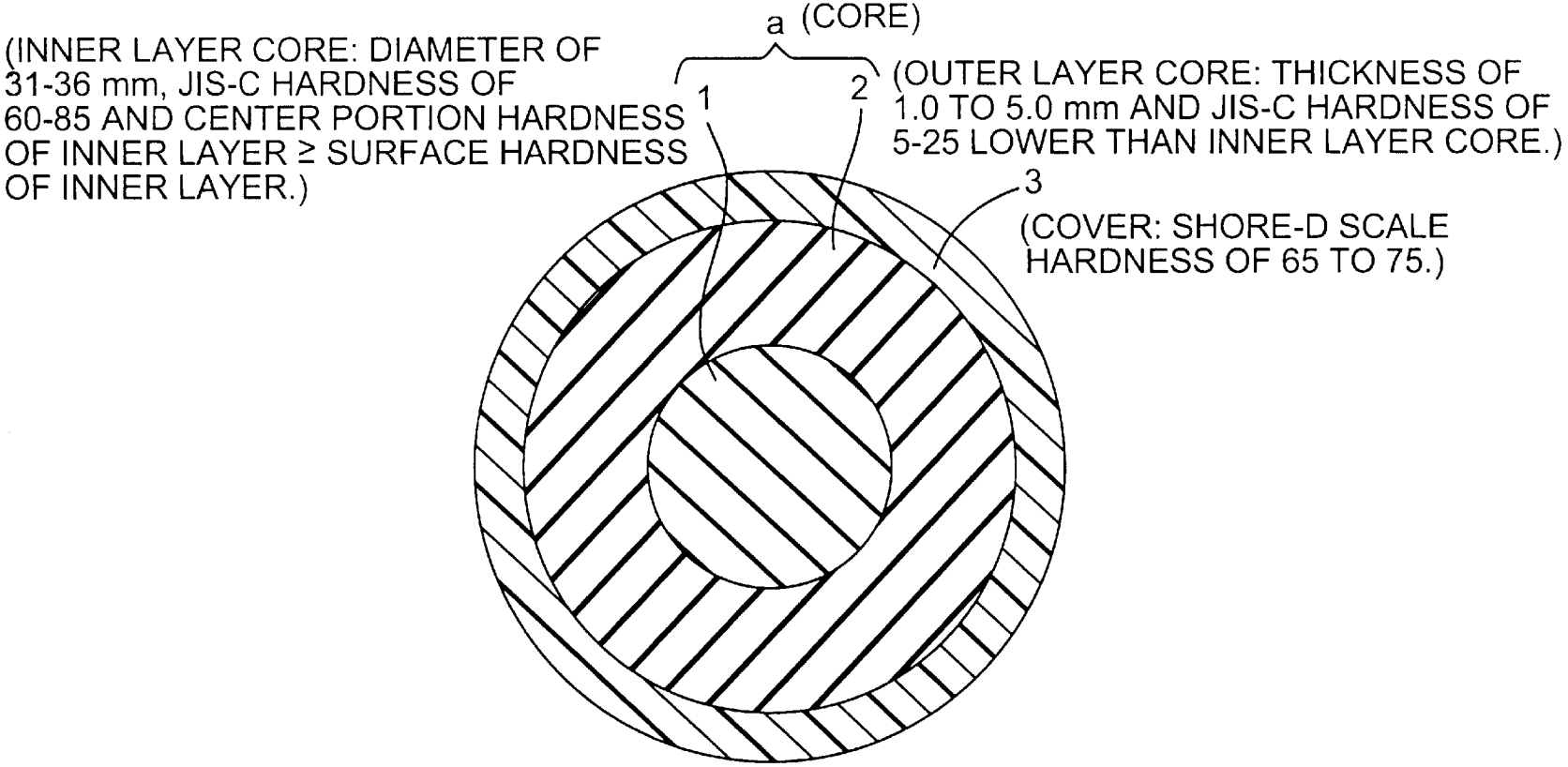
FIG. 1 is a schematic cross section illustrating a golf ball of the present invention.

The present invention relates to a three-piece solid golf ball comprising a core (a) and a cover (3) formed on the core, the core having a two-layer structure comprising an inner layer core (1) and an outer layer core (2), wherein the inner layer core (1) has a diameter of 31 to 36 mm and a JIS-C hardness of 60 to 85 and the core (2) has a lower JIS-C hardness than the inner layer core by an amount of 5 to 25. In order to carry out the present invention, it is preferred that the JIS-C hardness of the above inner layer core (1) is within ±7% based on a center portion hardness and at least satisfies the following inequality:

(Center portion hardness of inner layer core)≧(Surface hardness of inner layer core)

and, the cover (3) has a Shore D-scale hardness of 55 to 75.

DETAILED DESCRIPTION OF THE INVENTION

The present invention will be explained in detail hereinafter. It is preferred that the inner layer core (1) used in the present invention has a diameter of 31 to 36 mm. When the diameter is less than 31 mm, the ball compression is too soft and rebound performance is poor. On the other hand, when it exceeds 36 mm, the outer layer core is too thin and the presence of the outer layer is meaningless. It is preferred that the inner layer core (1) has a JIS-C hardness of 60 to 85. When the JIS-C hardness is less than 60, rebound performance is poor. On the other hand, when it exceeds 85 mm, shot feel is too hard. It is preferred that the JIS-C hardness of the above inner layer core (1) is uniform within ±7% based on its center portion hardness and at least satisfies the following expression:

(Center portion hardness of inner layer core)≧(Surface hardness of inner layer core).

When the JIS-C hardness of the above inner layer core (1) is not within ±7% based on its center portion hardness, the hardness from the center portion to the surface is not uniform and the rebound performance deteriorates. When the surface hardness exceeds the center portion hardness, shot feel is poor and the durability deteriorates.

It is also preferred that the JIS-C hardness of the outer layer core (2) is 5 to 25 lower than that of the inner layer core (1). When the JIS-C hardness is less than 5, shot feel is poor. On the other hand, when it exceeds 25, the hardness of the outer layer core is too low and rebound performance is poor.

A thickness of the outer layer core (2) is from 1 to 5 mm, preferably from 1.5 to 4.0 mm, because the diameter of the core (a) is generally from 38.0 to 40.0 mm. When the thickness of the outer layer core is smaller than 1 mm, the presence of the outer layer core is meaningless and shot feel is hard. On the other hand, when it exceeds 5 mm, the rebound performance is poor and the flight performance is poor.

The specific gravity of the core is preferably from 1.0 to 1.3 in view of the ball weight. In order to increase the moment of inertia, the specific gravity of the outer layer core is preferably more than that of the inner layer core. The specific gravity of the outer layer core is preferably from 1.1 to 1.3 and that of the inner layer core is preferably from 1.0 to 1.2.

The inner layer core (1) and outer layer core (2) used in the present invention are basically obtained by vulcanizing a rubber composition used as the core of the solid golf ball. The rubber composition generally contains a base rubber, a metal salt of an unsaturated carboxylic acid, an organic peroxide, a filler and the like. The base rubber includes natural rubber and/or a synthetic rubber which has been used in the solid golf ball. Particularly, a high-cis polybutadiene rubber having cis-1,4-bond of at least 40%, preferably at least 80% is preferred. If necessary, a natural rubber, a polyisoprene rubber, a styrene-butadiene rubber, EPDM and the like may be added. The term "base rubber" generally means rubber components which are mainly contained in the rubber component of the rubber composition and which predominantly shows the performance of the rubber.

The metal salt of the unsaturated carboxylic acid acts as a co-crosslinking agent, and examples thereof include a monovalent or divalent metal salt (e.g. zinc, magnesium salt, etc.) of an α,β-unsaturated carboxylic acid having 3 to 8 carbon atoms (e.g. acrylic acid, methacrylic acid, etc.). Among them, zinc acrylate which imparts a high rebound performance is preferred. It is preferred that the amount of the metal salt blended is from 18 to 35 parts by weight in the inner layer and is from 15 to 30 parts by weight in the outer layer, based on 100 parts by weight of the base rubber. When the amount is larger than 35 parts by weight in the inner layer or larger than 30 parts by weight in the outer layer, shot feel is poor. On the other hand, when the amount is smaller than 18 parts by weight in the inner layer or smaller than 15 parts by weight in the outer layer, rebound performance is poor and flight distance is lowered.

The organic peroxide acts as crosslinking agent or curing agent, and examples thereof include dicumyl peroxide or t-butyl peroxide. Among them, dicumyl peroxide is preferred. It is preferred that an amount of the organic peroxide blended is from 0.5 to 1.5 parts by weight in the inner layer and is from 0.5 to 2.5 parts by weight in the outer layer, based on 100 parts by weight of the base rubber. When the amount is less than 0.5 part by weight in the inner layer or less than 0.5 part by weight in the outer layer, the layer is too soft. Therefore, the rebound performance is poor and the flight distance is lowered. On the other hand, when the amount exceeds 1.5 parts by weight in the inner layer or exceeds 2.5 parts by weight in the outer layer, the layer is too hard and shot feel is poor.

The filler may be any one which is generally blended in the core of the golf ball, and examples thereof include an inorganic salt (e.g. zinc oxide, barium sulfate, calcium carbonate, etc.), a high-specific gravity metallic powder (e.g. tungsten powder, molybdenum powder, etc.) and a mixture thereof.

Another component which can generally be used in the production of the core of the solid golf ball, such as antioxidants, peptizing agents, etc. may be added to the rubber composition of the core of the golf ball of the present invention.

In the present invention, an outer layer core (2) is formed on an inner layer core (1). A difference in hardness between the inner layer core and outer layer core is adjusted by changing the amount, sorts of component and vulcanization condition of the rubber composition.

The above core is then covered with a cover (3).

The cover can be formed from ionomer resin and balata, which are generally used as cover material of the solid golf ball, and a small amount of the other resin may be added. In addition, the above cover composition may contain fillers such as barium sulfate, etc., additives for coloring, such as titanium dioxide, etc. and other additives such as ultraviolet absorbers, light stabilizers, fluorescent materials, fluorescent brighteners, etc. as far as desired characteristics due to the golf ball cover are not deteriorated.

The cover layer of the present invention is formed by a generally known method used for forming the cover of the golf ball, e.g. injection molding, press molding and the like. It is preferred that the cover of the golf ball of the present invention has a Shore D-scale hardness of 55 to 75. When the Shore D-scale hardness is less than 55, rebound performance is deteriorated. On the other hand, when it exceeds 75, shot feel is hard. A thickness of the cover layer is preferably from 1 to 4 mm. When the thickness is less than 1 mm, the hardness of the whole golf ball is small and the rebound coefficient is small. On the other hand, when it exceeds 4 mm, the hardness of the whole golf ball is large and controllability and shot feeling are poor. The cover layer has a Shore D-scale hardness of preferably 55 to 75, more preferably 60 to 75. When the Shore D-scale hardness is less than 55, rebound performance is poor. On the other hand, when it exceeds 75, shot feel is poor. When covering, a large number of depressions, so-called "dimples", are formed on the surface. The golf ball of the present invention is generally coated with paint in order to enhance appearance and commercial value, and then put on the market.

The present invention provides a solid golf ball whose flight performance and durability are improved without deteriorating shot feel and rebound performance.

In the golf ball of the present invention, comprising a core and a cover (3) formed on the core, the core having a two-layer structure of an inner layer core (1) and an outer layer core (2), the flight performance and durability are improved without causing a deterioration in the shot feel at the time of hitting, by setting a diameter, a hardness and a hardness distribution of the inner layer core (1), a hardness of the outer layer core (2) and a hardness of the cover (3) within a specific range.

EXAMPLES

The following Examples and Comparative Examples further illustrate the present invention in detail but are not to be construed to limit the scope thereof.

Examples 1 to 8 and Comparative Examples 1 to 3

Inner layer core

A composition for inner layer core of a formulation shown in Table 1 was kneaded, followed by press-molding under the following vulcanization condition to produce a spherical inner layer core having a specific gravity and a diameter shown in Table 1.

TABLE 1

(Parts by weight)

| | Example No. | | | | | | | | Comparative Example No. | | |
|---|---|---|---|---|---|---|---|---|---|---|---|
| | 1 | 2 | 3 | 4 | 5 | 6 | 7 | 8 | 1 | 2 | 3 |
| BR11[1] | 100 | 100 | 100 | 100 | 100 | 100 | 100 | 100 | 100 | 100 | 100 |
| Zinc acrylate | 25 | 22 | 19 | 25 | 22 | 22 | 25 | 28 | 22 | 15 | 22 |
| Zinc oxide | 19.6 | 20.7 | 21.8 | 19.6 | 20.7 | 20.7 | 19.6 | 18.5 | 20.7 | 23.3 | 20.7 |
| Antioxidant[2] | 0.5 | 0.5 | 0.5 | 0.5 | 0.5 | 0.5 | 0.5 | 0.5 | 0.5 | 0.5 | 0.5 |
| Dicumyl peroxide | 1.0 | 1.0 | 1.0 | 1.0 | 1.0 | 1.0 | 1.2 | 1.0 | 1.0 | 1.0 | 0.8 |
| Specific gravity | 1.13 | 1.13 | 1.13 | 1.13 | 1.13 | 1.13 | 1.13 | 1.13 | 1.13 | 1.13 | 1.13 |
| Diameter (mm) | 32 | 36 | 35 | 35 | 35 | 35 | 31 | 35 | 27 | 35 | 35 |
| Vulcanization condition | A | A | A | A | A | A | A | A | A | A | B |

Vulcanization condition
A: 140° C. × 30 minutes + 165° C. × 8 minutes
B: 165° C. × 20 minutes Outer layer core The above inner layer core was concentrically covered with a composition for outer layer core of a formulation shown in Table 2, followed by vulcanizing at 150° C. for 20 minutes to obtain a spherical core having a diameter of 39 mm and a specific gravity shown in Table 2.

TABLE 2

(Parts by weight)

| | Example No. | | | | | | | | Comparative Example No. | | |
|---|---|---|---|---|---|---|---|---|---|---|---|
| | 1 | 2 | 3 | 4 | 5 | 6 | 7 | 8 | 1 | 2 | 3 |
| BR11[1] | 100 | 100 | 100 | 100 | 100 | 100 | 100 | 100 | 100 | 100 | 100 |
| Zinc acrylate | 22 | 19 | 15 | 15 | 19 | 19 | 21 | 22 | 19 | 31 | 17 |
| Zinc oxide | 20.7 | 21.8 | 23.3 | 23.3 | 21.8 | 21.8 | 21.0 | 20.7 | 21.8 | 17.4 | 23.3 |
| Antioxidant | 0.5 | 0.5 | 0.5 | 0.5 | 0.5 | 0.5 | 0.5 | 0.5 | 0.5 | 0.5 | 0.5 |
| Dicumyl peroxide | 1.0 | 1.0 | 1.0 | 1.0 | 1.0 | 1.0 | 2.0 | 1.0 | 1.0 | 1.0 | 1.0 |
| Specific gravity | 1.13 | 1.13 | 1.13 | 1.13 | 1.13 | 1.13 | 1.13 | 1.13 | 1.13 | 1.13 | 1.13 |

Cover

The resulting solid core was covered with a cover composition of a formulation shown in Table 3 and, after removing burr formed on a flash line of molds, paint was applied to obtain a solid golf ball having a diameter of 42.7 mm.

TABLE 3

(Parts by weight)

| Kind | a | b |
|---|---|---|
| IOTEC8000[3] | 50 | — |
| IOTEC7010[4] | 50 | — |
| Hi-milan 1706[5] | — | 50 |
| Hi-milan 1605[6] | — | 50 |
| Barium sulfate | 2.0 | 2.0 |

1) Polybutadiene, manufactured by Japan Synthetic Rubber Co., Ltd.
2) Yoshinox 425, manufactured by Yoshitomi Pharmaceutical Industries, Ltd.
3) Ionomer resin (Shore D-scale hardness* 61), manufactured by Exxon Co.
4) Ionomer resin (Shore D-scale hardness* 57), manufactured by Exxon Co.
5) Ionomer resin (Shore D-scale hardness* 66), manufactured by Mitsui Du Pont Polychemical Co., Ltd.
6) Ionomer resin (Shore D-scale hardness* 67), manufactured by Mitsui Du Pont Polychemical Co., Ltd.

*ASTM D 2240

With respect to the resulting solid golf ball, the diameter and hardness of the inner layer core, hardness of the outer layer core, hardness of the cover, launch angle, spin, flight distance (carry), durability index and feeling at the time of hitting are shown in Table 4 (Examples) and Table 5 (Comparative Examples). A test method is as follows.

(Test method)

(1) Launch angle, flight distance and spin

A driver (w#1) was attached to a Swing robot manufactured by True Temper Co. and a golf ball was hit at a head speed of 45 m/second. A distance (carry) to the dropping point was measured as a flight distance and a launch angle was measured. Spin was measured by continuously taking a photograph of the golf ball hit.

(2) Durability index

A driver (w#1) was attached to a Swing robot manufactured by True Temper Co. and a golf ball was hit at a head speed of 45 n/second and the number of hitting until the breakage arose (resistance number to impact) was measured. The resulting value was indicated by an index in case of the value of Example 1 being 100.

(3) Feeling at the time of hitting

It was evaluated by practically hitting with 10 professional golfers. Evaluation criteria are as follows. Evaluation criteria:

◎: Excellent
○: Good
Δ: Ordinary
X: Too soft (Test results)

TABLE 4

| | Example No. | | | | | | | |
|---|---|---|---|---|---|---|---|---|
| | 1 | 2 | 3 | 4 | 5 | 6 | 7 | 8 |
| Diameter of inner layer core (mm) | 32 | 32 | 32 | 32 | 32 | 32 | 32 | 32 |
| Hardness of inner layer core (JIS-C) | | | | | | | | |
| Center portion | 78.8 | 74 | 67.5 | 79.5 | 75 | 75 | 78.5 | 84 |
| 5 mm | 79 | 74 | 68 | 79 | 75 | 75 | 79 | 84.5 |
| 10 mm | 79 | 74.5 | 67 | 79 | 75.4 | 75.4 | 79 | 84 |
| 15 mm | 79.8 | 74 | 67 | 79.6 | 76 | 76 | 78.8 | 84 |
| Surface | 78 | 73 | 65 | 76 | 74 | 74 | 78 | 82 |
| Hardness of outer layer core (JIS-C) | 73 | 67 | 60 | 60 | 67 | 67 | 70 | 74 |
| Difference in hardness* | 5.0–6.8 | 5.0–7.5 | 5.0–8.0 | 16–19.6 | 7.0–9.0 | 7.0–9.0 | 7.0–9.0 | 8.0–10.5 |
| Formulation of cover | a | a | a | a | a | b | b | a |
| Hardness of cover (Shore D-scale hardness) | 72 | 72 | 72 | 72 | 72 | 70 | 70 | 72 |
| Flight performance (W#1) | | | | | | | | |
| Launch angle (degree) | 11.10 | 11.45 | 11.35 | 11.27 | 11.38 | 11.34 | 11.10 | 11.25 |
| Spin | 2850 | 2690 | 2710 | 2880 | 2730 | 2810 | 2855 | 2890 |
| Flight distance (yard) | 227.0 | 229.6 | 227.6 | 229.3 | 228.8 | 227.3 | 226.6 | 229.5 |
| Durability index | 100 | 125 | 120 | 110 | 115 | 125 | 110 | 110 |
| Feeling | ○ | ◎ | ○ | ○ | ◎ | ○ | ○ | ○ |

*Difference in hardness = (hardness of inner layer core) − (hardness of outer layer core)

TABLE 5

| | Comparative Example No. | | |
|---|---|---|---|
| | 1 | 2 | 3 |
| Diameter of inner layer core (mm) | 27 | 35 | 35 |
| Hardness of inner layer core (JIS-C) | | | |
| Center portion | 74 | 60 | 65 |
| 5 mm | 74 | 60 | 67 |
| 10 mm | 74 | 60.5 | 68 |
| 15 mm | — | 59 | 73 |
| Surface | 73 | 56 | 75 |
| Hardness of outer layer core (JIS-C) | 67 | 85 | 64 |
| Difference in hardness* | 6.0–7.0 | −29–−24.5 | 1.0–11.0 |
| Formulation of cover | a | a | a |
| Hardness of cover (Shore D-scale hardness) | 72 | 72 | 72 |
| Flight performance (W#1) | | | |
| Launch angle (degree) | 10.90 | 11.27 | 11.25 |
| Spin | 3060 | 2700 | 2760 |
| Flight distance (yard) | 224.5 | 226.1 | 225.3 |
| Durability index | 65 | 60 | 70 |
| Feeling | X | ○ | Δ |

*Difference in hardness = (hardness of inner layer core) - (hardness of outer layer core)

As is apparent from the above results, the golf balls of Examples 1 to 8 are superior in flight distance, durability and feeling to those of Comparative Examples 1 to 3.

What is claimed is:

1. A three-piece solid golf ball comprising: a core and a cover formed on the core, wherein said core having a two-layer structure of an inner layer core and an outer layer core, wherein said inner layer core has a diameter of 31 to 36 mm and a JIS-C hardness of 60 to 85 and said outer layer core has a lower JIS-C hardness than the inner layer core by 5 to 25, and the JIS-C hardness of said inner layer core is uniform within ±7% based on a center portion hardness and the hardness of the center portion of said inner layer core is greater than or equal to the surface hardness of said inner layer core.

2. The three-piece solid golf ball according to claim 1, wherein the cover has a Shore-D scale hardness of 55 to 75.

3. Three three-piece solid golf ball according to claim 1, wherein both the inner layer core and outer layer core are composed of a vulcanized product of a rubber composition containing a base rubber, a metal salt of an unsaturated carboxylic acid, an organic peroxide and a filler.

4. The three-piece solid golf ball according to claim 1, wherein the outer layer core has a thickness of from 1 to 5 mm.

5. The three-piece solid golf ball according to claim 1, wherein the outer layer core has a thickness of from 1.5 to 4.0 mm.

6. The three-piece solid golf ball according to claim 1, wherein the core has a diameter of 38 to 40 mm.

7. The three piece solid golf ball according to claim 1, wherein the core has a specific gravity from 1.0 to 1.3.

8. The three piece solid golf ball according to claim 1, wherein the outer layer core has a specific gravity from 1.1 to 1.3 and the inner layer core has a specific gravity from 1.0 to 1.2.

9. The three-piece solid golf ball according to claim 1, wherein the cover has a Shore-D scale hardness of 60 to 75.

* * * * *